US007673594B2

(12) United States Patent
Hirayama et al.

(10) Patent No.: US 7,673,594 B2
(45) Date of Patent: Mar. 9, 2010

(54) WATER-COOLED INTERNAL COMBUSTION ENGINE HAVING RADIATOR

(75) Inventors: Shuji Hirayama, Saitama (JP); Teruhide Yamanishi, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 72 days.

(21) Appl. No.: 11/898,321

(22) Filed: Sep. 11, 2007

(65) Prior Publication Data

US 2008/0066696 A1 Mar. 20, 2008

(30) Foreign Application Priority Data

Sep. 14, 2006 (JP) ..... 2006-250126
Jun. 26, 2007 (JP) ..... 2007-168055

(51) Int. Cl.
*F01P 5/10* (2006.01)

(52) U.S. Cl. ..... 123/41.44; 123/41.1; 123/41.82 R

(58) Field of Classification Search ..... 123/41.1, 123/41.08, 41.44, 41.82 R, 41.47, 41.51; 165/41, 51

See application file for complete search history.

(56) References Cited

U.S. PATENT DOCUMENTS 4,745,887 A 5/1988 Hiroyuki et al.
6,516,755 B2 * 2/2003 Gregory ..... 123/41.1
6,971,438 B2 * 12/2005 Oki et al. ..... 165/41

FOREIGN PATENT DOCUMENTS

EP 0 374 038 A1 6/1990
JP 2005-9499 A 1/2005
JP 2005-009499 A 1/2005

* cited by examiner

*Primary Examiner*—Noah Kamen
(74) *Attorney, Agent, or Firm*—Birch, Stewart, Kolasch & Birch, LLP

(57) ABSTRACT

A water circulation structure of a cylinder block having a compact layout of piping connecting an engine body and a radiator. A water-cooled internal combustion engine is provided with an engine body including a cylinder block and a cylinder head and a radiator. The radiator is disposed to be separated, in a prescribed direction, i.e. in a rightward direction, from the engine body. A cooling water outlet portion is open to a cylinder head water jacket and is provided in the end portion of the cylinder head. The cooling water outlet portion being connected with an inlet pipe for leading the cooling water flowing out of a cylinder block water jacket into the cylinder head water jacket to the radiator. The cooling water outlet portion is disposed to the right closer to the radiator than a chain chamber.

22 Claims, 9 Drawing Sheets

WATER-COOLED INTERNAL COMBUSTION ENGINE HAVING RADIATOR

CROSS-REFERENCE TO RELATED APPLICATIONS

The present application claims priority under 35 USC 119 to Japanese Patent Application Nos. 2006-250126 and 2007-168055 filed on Sep. 14, 2006 and Jun. 26, 2007 the entire contents of which are hereby incorporated by reference.

BACKGROUND OF THE INVENTION

1. Field of the Invention

The present invention relates to a water-cooled internal combustion engine having a radiator through which cooling water circulates from water jackets provided in a cylinder block and a cylinder head included in an engine body.

2. Description of Background Art

A cooling device for an internal combustion engine is known wherein a radiator through which the cooling water circulates from water jackets provided in an engine including a cylinder block and a cylinder head. The cooling device is disposed and is separated from the engine body in a prescribed direction. A supply pipe is connected to the cylinder block for supplying the low-temperature cooling water pressure fed by a water pump after radiating heat at the radiator to the water jackets. An inlet pipe for leading the cooling water coming from the water jackets after cooling the cylinder block and the cylinder head to the radiator is connected to the cylinder block. See, for example, JP-A No. 2005-9499.

In an internal combustion engine in which a supply pipe and an inlet pipe are connected to a cylinder block, the cylinder block is required to be provided with a return water path for returning the cooling water flowing out of the cylinder block into a cylinder head for thereby cooling the cylinder head back to the cylinder block. This complicates the cooling water circulation structure of the cylinder block and enlarges the cylinder block so as to accommodate the return water path. If, in such a case, a thermostat is to be installed in the cylinder block, the cooling water circulation structure of the cylinder block is further complicated.

In an internal combustion engine in which an accommodation chamber for accommodating, for example, a transmission mechanism for rotationally driving the cam shaft of a valve train is disposed in an end portion toward a radiator of the engine body. The accommodation chamber is positioned between water jackets and the radiator. As a result, the distance in a prescribed direction between the radiator and the water jackets, all separated from the engine body in the prescribed direction, is lengthened by an amount equivalent to the length in the prescribed direction of the accommodation chamber. This results in longer cooling water piping connecting the engine body and the radiator, making it difficult to compactly lay out the cooling water piping.

In cases in which a temperature sensor for detecting the temperature of the water jacket cooling water is used to detect the engine temperature, it is preferable for the purpose of detecting the temperature of the engine body as a whole that the temperature sensor should be disposed in a location that is not much affected by local water temperature changes in the water jackets. Furthermore, the disposition of the temperature sensor preferably should not prevent the cooling water piping from being compactly laid out.

Still furthermore, in cases in which an air vent pipe for letting out air inside a water pump is connected to the radiator, the air vent pipe is lengthened to result in restricting the layout of other cooling water pipes. This complicates the layout of the cooling water piping.

SUMMARY AND OBJECTS OF THE INVENTION

The present invention has been made in view of the above circumstance. According to an embodiment of the present invention, a water circulation structure of a cylinder block is simplified and a compact layout of cooling water piping connecting an engine body and a radiator is realized.

According to an embodiment of the present invention, an improved cooling efficiency is provided by appropriately locating the cooling water piping.

According to an embodiment of the present invention, a compact lay out of the cooling water piping is promoted by appropriately determining a position for disposing a temperature sensor for detecting cooling water temperature.

According to an embodiment of the present invention, the accuracy is improved in detecting the temperature of the engine body as a whole and in compactly disposing the temperature sensor.

According to an embodiment of the present invention, a compact layout of the cooling water piping is realized by shortening an air vent pipe connected to a water pump.

According to an embodiment of the present invention, a water-cooled internal combustion engine including an engine body with a cylinder block provided with a cylinder block water jacket and a cylinder head provided with a cylinder head water jacket. A cooling device is provided with a water pump which pressure-feeds cooling water to the water jackets, and a radiator through which the cooling water of the water jackets circulates. The radiator is disposed to be separated from the engine body in a prescribed direction and an accommodation chamber which accommodates a transmission mechanism for a valve system is disposed to extend along a cylinder axis, from the cylinder block to the cylinder head and is provided in an end portion toward the radiator in the prescribed direction of the engine body. In the water-cooled internal combustion engine, a cooling water outlet portion open to the cylinder head water jacket is provided in a portion, included in the end portion, of the cylinder head. The cooling water outlet portion is connected with an inlet pipe for leading the cooling water flowing out of the cylinder block water jacket into the cylinder head water jacket to the radiator. The cooling water outlet portion is disposed closer, in the prescribed direction, to the radiator than the accommodation chamber.

According to an embodiment of the present invention, the cooling water outlet portion is open to an upper end portion of the cylinder head water jacket with a cooling water inlet portion through which the cooling water having radiated heat at the radiator enters the cylinder block water jacket is provided in a lower end portion of the cylinder block.

According to an embodiment of the present invention, the cooling device is provided with a thermostat for performing control to establish or shut off a cooling water circulation through the radiator according to a state of warming up of the engine. The water pump and the thermostat are both attached to the end portion to be closer, in the prescribed direction, to the radiator than the accommodation chamber.

According to an embodiment of the present invention, a temperature sensor is provided which is attached to the portion, included in the end portion, of the cylinder head to detect cooling water temperature and extends in a direction orthogonal to the prescribed direction outside the cylinder head.

According to an embodiment of the present invention, the water-cooled internal combustion engine further includes an intake device forming an intake path which extends in a cylinder axis direction of the cylinder block as seen in the orthogonal direction. A pipe connection section including the cooling water outlet portion is provided in the portion, included in the end portion, of the cylinder head; and the temperature sensor is fixed to the pipe connection section in a location, as seen in the prescribed direction, between the intake path and cooling water piping which is connected to the pipe connection section and through which the cooling water passes.

According to an embodiment of the present invention, an air vent pipe for letting out air accumulated in the water pump that is attached to the portion, included in the end portion, of the cylinder head to be closer, in the prescribed direction, to the radiator than the accommodation chamber is connected, in the prescribed direction, to the pipe connection section and communicated with the cylinder head water jacket.

According to an embodiment of the present invention, the cooling water, after cooling the cylinder block, flows into the cylinder head water jacket and having thereby cooled the cylinder head need not be made to go through the cylinder block again before being sent out to the radiator. This simplifies the water circulation structure in the cylinder block and makes the cylinder block smaller. Furthermore, since the cooling water outlet portion is disposed, in the prescribed direction, closer to the radiator than the accommodation chamber, the inlet pipe can be shortened to reduce its line resistance and improve cooling efficiency. This makes the layout of the inlet pipe compact.

According to an embodiment of the present invention, the cooling water flowing in from the lower end portion of the cylinder block enters the cylinder head water jacket after flowing through the cylinder block water jacket and subsequently flows out of the upper end portion of the cylinder head water jacket to the radiator. Thus, the cooling water circulates smoothly, allowing the cylinder block and the cylinder head to be cooled with improved efficiency.

According to an embodiment of the present invention, even though the accommodation chamber is disposed between, in the prescribed direction, the water jackets and the radiator in the engine body, the cooling water outlet portion, the water pump, and the thermostat are concentratedly disposed close to the radiator. This makes it possible to shorten the cooling water piping, improve cooling efficiency, and compactly lay out the cooling water piping.

According to an embodiment of the present invention, even though the temperature sensor is attached to an end portion of the cylinder head, it extends in a direction orthogonal to the prescribed direction outside the cylinder head, so that the exposed part exposed outside the cylinder head of the temperature sensor is prevented from interfering with the layout of the cooling water piping, including the inlet pipe, disposed closer to the radiator than the end portion of the cylinder head. This promotes compactly laying out the cooling water piping.

According to an embodiment of the present invention, the temperature sensor is attached to the pipe connection section wherein the cooling water outlet portion through which the cooling water coming from the cylinder head water jacket heads for the radiator is provided. Thus, the temperature sensor is disposed at a location where the cooling water having passed the cylinder block water jacket and cylinder head water jacket collects before being sent out of the engine body toward the radiator. The temperature sensor can therefore detect the water temperature at the location not much affected by local water temperature changes in the water jackets. This improves the accuracy in detecting the temperature of the engine body as a whole.

Furthermore, the temperature sensor is disposed compactly in a space between, in the prescribed direction, the intake path and the cooling water piping connected to the pipe connection section.

According to an embodiment of the present invention, the air vent pipe is connected, in the prescribed direction, to the pipe connection section provided in the end portion of the cylinder head, so that the air vent pipe can be shortened as compared with a case in which it is connected to the radiator. This contributes toward making the layout of the cooling water piping, including the air vent pipe, disposed closer, in the prescribed direction, to the radiator than the end portion compact. Even though the temperature sensor is provided in the pipe connection section, it extends in a direction orthogonal to the prescribed direction. The air vent pipe can therefore be connected to the pipe connection section without being interfered with by the temperature sensor. This also contributes toward making the layout of the cooling water piping compact.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Embodiments of the present invention will be described with reference to FIGS. 1 to 9.

FIGS. 1 to 7 are for describing a first embodiment of the present invention.

Figure 1:
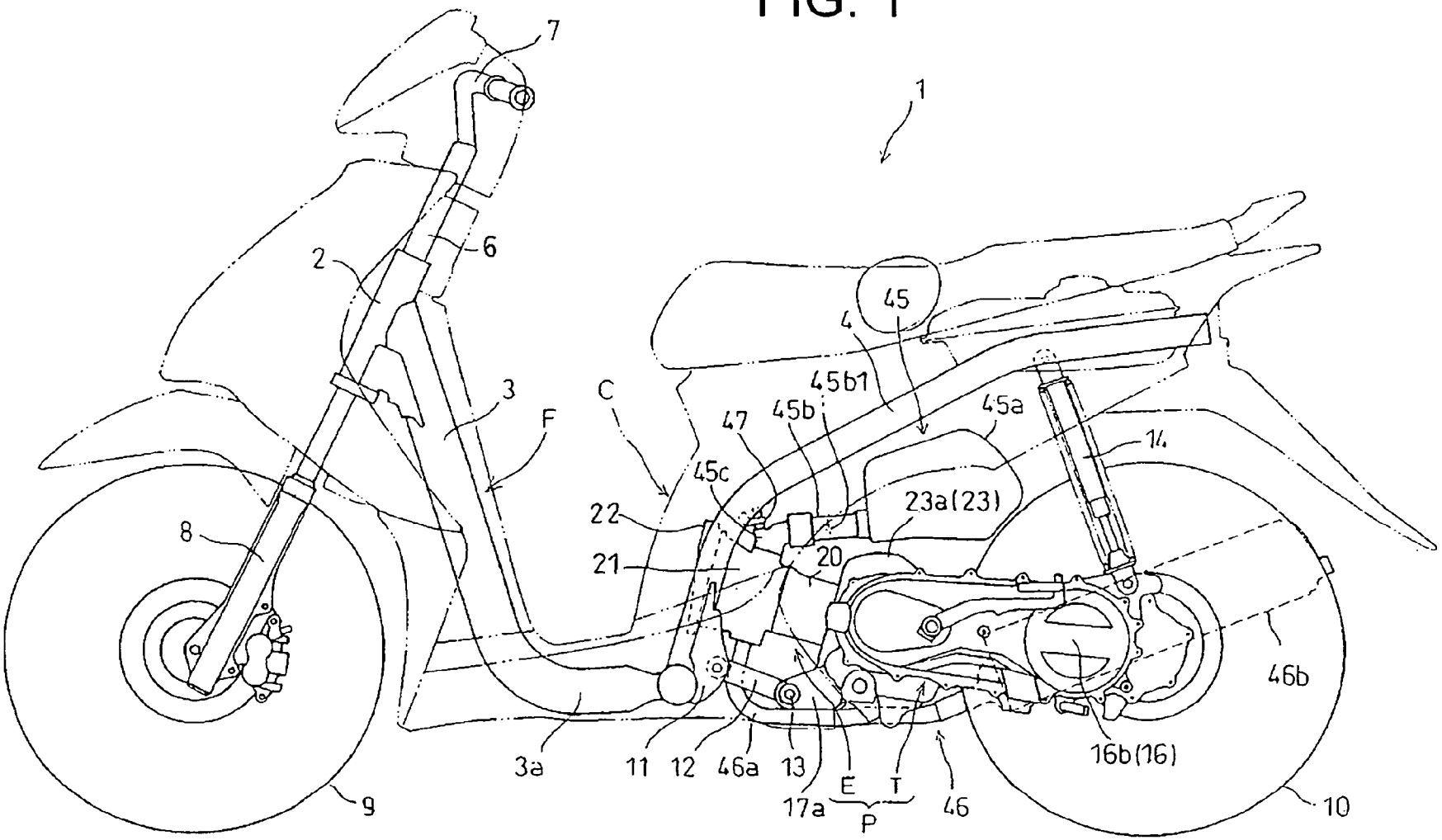
FIG. 1 is a left side view of a motorcycle equipped with a water-cooled internal combustion engine according to a first embodiment of the present invention.

Referring to FIG. 1, a scooter-type motorcycle 1 which is a vehicle equipped with a water-cooled internal combustion engine E according to the present invention has a vehicle body including a body frame F and a synthetic resin body cover C for covering the body frame F. The body frame F includes a head pipe 2 positioned in a front end portion of the vehicle body, a down tube 3 extending rearwardly and downwardly from the head pipe 2, a pair of left and right rear frames 4 being connected to a horizontal portion 3*a* in a lower portion of the down tube 3 and extending rearwardly and upwardly from both sides of the horizontal portion 3*a*, and a plurality of cross members (not shown) connecting the left and right rear frames 4.

Note that, upper and lower means upper and lower in the vertical direction. Also, front, rear, left, and right coincide with front, rear, left, and right of the motorcycle 1. Namely, left and right are opposite to each other in the direction of the rotational axis La of a cam shaft 40*a* being described later.

A steering shaft 6 which is rotatable supported about the head pipe 2 has a steering handlebar 7 connected to an upper end portion thereof and a front fork 8 connected to a lower end portion thereof. A front wheel 9 is journaled to a lower end portion of the front fork 8. A rear wheel 10 is journaled to a rear end portion of a power unit P for generating power to rotationally drive the rear wheel 10. The power unit P is, at a front end portion thereof, pivoted on a pivot shaft 13 via a pair of brackets 17*a* and 17*b* (see also FIG. 2) which are provided for a crankcase 23 being described later. The pivot shaft 13 is supported, via a link 12, by a support plate 11 connected to a front portion of the pair of rear frames 4. The power unit P is, at a rear end portion thereof, supported by a rear portion of the left rear frame 4 via a rear suspension 14. Thus, the power unit P is vertically rockably supported by the body frame F.

Figure 2:
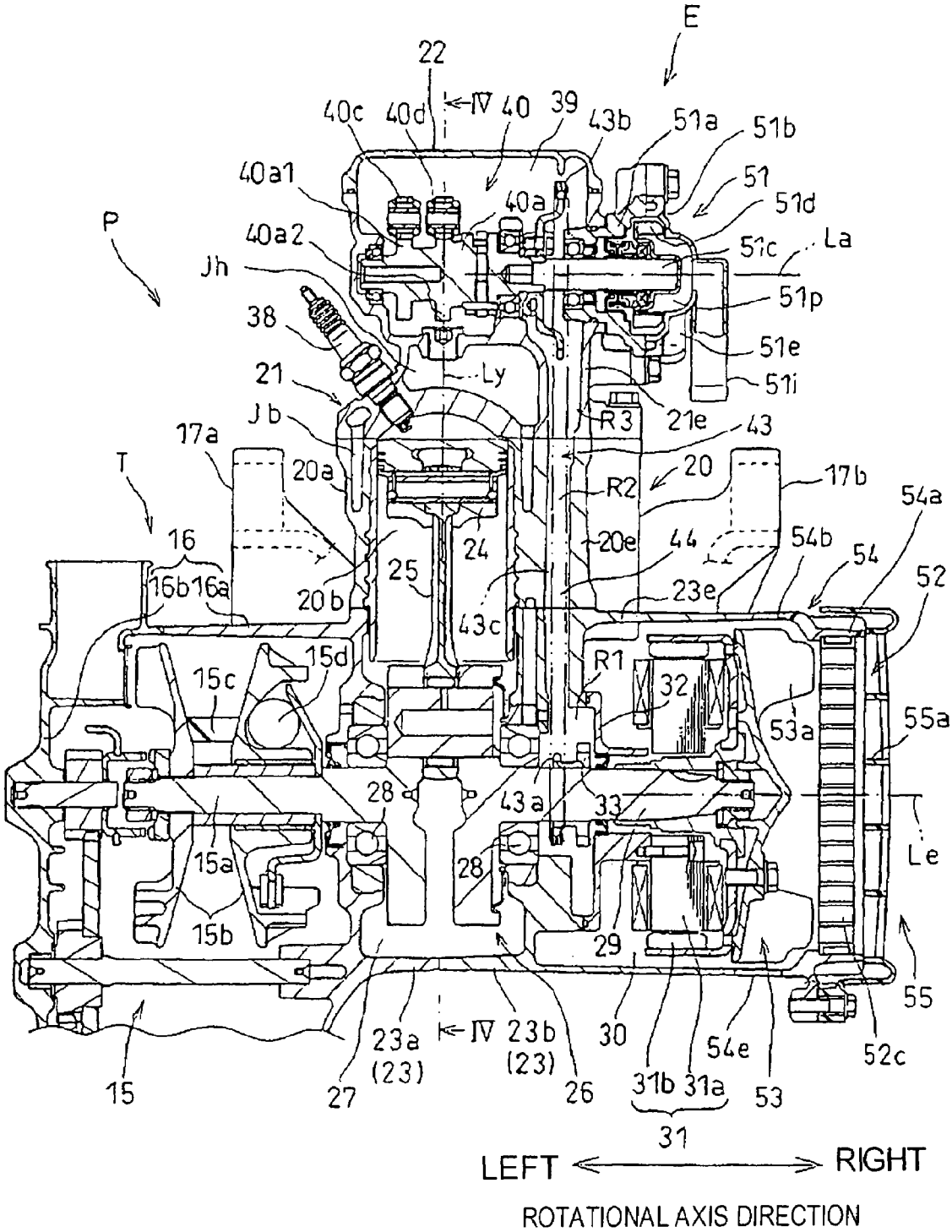
FIG. 2 is a cross-sectional view of an essential part, including the cylinder axis, of the internal combustion engine shown in FIG. 1, the cross-sectional view mainly showing a plane parallel with the rotational axis of the crankshaft.

Referring also to FIG. 2, the power unit P supported by the body frame F and disposed in a left portion of the vehicle body includes a transverse-mounted internal combustion engine E with a crankshaft 26 having a rotational axis Le extending in the vehicle width direction (lateral direction) and a power transmission system T for transmitting the power generated by the internal combustion engine E to the rear wheel 10. The power transmission system T includes a belted transmission 15 as a speed changer and a transmission case 16 housing the transmission 15. The transmission 15 includes a driven pulley 15*b* mounted on a drive shaft 15*a* which is formed coaxially and integrally with the crankshaft 26 and rotationally driven by the crankshaft 26. A driven pulley (not shown) is mounted on an output shaft connected to the rear wheel 10 via a final speed reduction mechanism with a V-belt 15*c* spanning the drive pulley 15*b* and the driven pulley. The gear ratio of the transmission 15 is automatically changed as a centrifugal weight 15*d* which moves according to the rotational speed of the engine changes the effective radius of the drive pulley 15*b* causing the effective radius of the driven pulley to also change at the same time. The transmission case 16 includes a case body 16*a* and a transmission cover 16*b* coupled to a left end portion of the case body 16*a*.

Referring to FIGS. 1 to 4, the internal combustion engine E has an engine main body which includes a cylinder block 20 having a cylinder 20*a*. The cylinder 20*a* includes a cylinder bore 20*b* into which a piston 24 is reciprocally movably fitted, a cylinder head 21 coupled to a front end portion (or one end portion in the cylinder axis direction) of the cylinder block 20, a head cover 22 coupled to a front end portion of the cylinder head 21, and the crankcase 23 coupled to a rear end portion (or the other end portion in the cylinder axis direction) of the cylinder block 20. The cylinder 20*a* is disposed on the body frame F in a position somewhat upwardly inclined from the horizontal, i.e. in a largely forwardly tilted position, such that an axis Ly of the cylinder extends forwardly and somewhat upwardly. The crankcase 23 is formed integrally with the case body 16*a*. It is divided into a left half case 23*a* formed integrally with the bracket 17*a* and a right half case 23*b* formed integrally with the bracket 17*b*. The crankshaft 26, connected to the piston 24 via a connecting rod 25, is disposed in a crank chamber 27 formed by the crankcase 23 and rotatably supported by the half cases 23*a* and 23*b* via a pair of main bearings 28.

Referring to FIG. 2, a left end portion of the crankshaft 26 projecting to the left from inside the crank chamber 27 extends into the transmission case 16 and makes up a drive shaft 15*a*. A right end portion of the crankshaft 26 projecting to the right from inside the crank chamber 27 extends into an accessory chamber 30 housing an AC generator 31. A cooling fan 53 provides a drive shaft 29 for the AC generator 31 and the cooling fan 53. Thus, the drive shaft 29 is formed coaxially and integrally with the crankshaft 26 and is rotationally driven by the crankshaft 26. The accessory chamber 30 includes a right end portion 23*e* of the half case 23*b* and a cylindrical shroud 54 coupled to the right end portion 23*e*.

The accessory chamber 30 is separated, by a dividing wall 32 which is a part coupled to the half case 23*b* and holds a stator 31*a* of the AC generator 31, from a space R1 formed by the dividing wall 32 and the half case 23*b*. The space R1 formed between, in the lateral direction, the crank chamber 27 and the accessory chamber 30 accommodates a drive sprocket 43*a* of a transmission mechanism 43 for a valve system which drives a cam shaft 40*a* of a valve train 40 and a drive gear 33 of a transmission mechanism for accessories which drives an oil pump (not shown).

Figure 4:
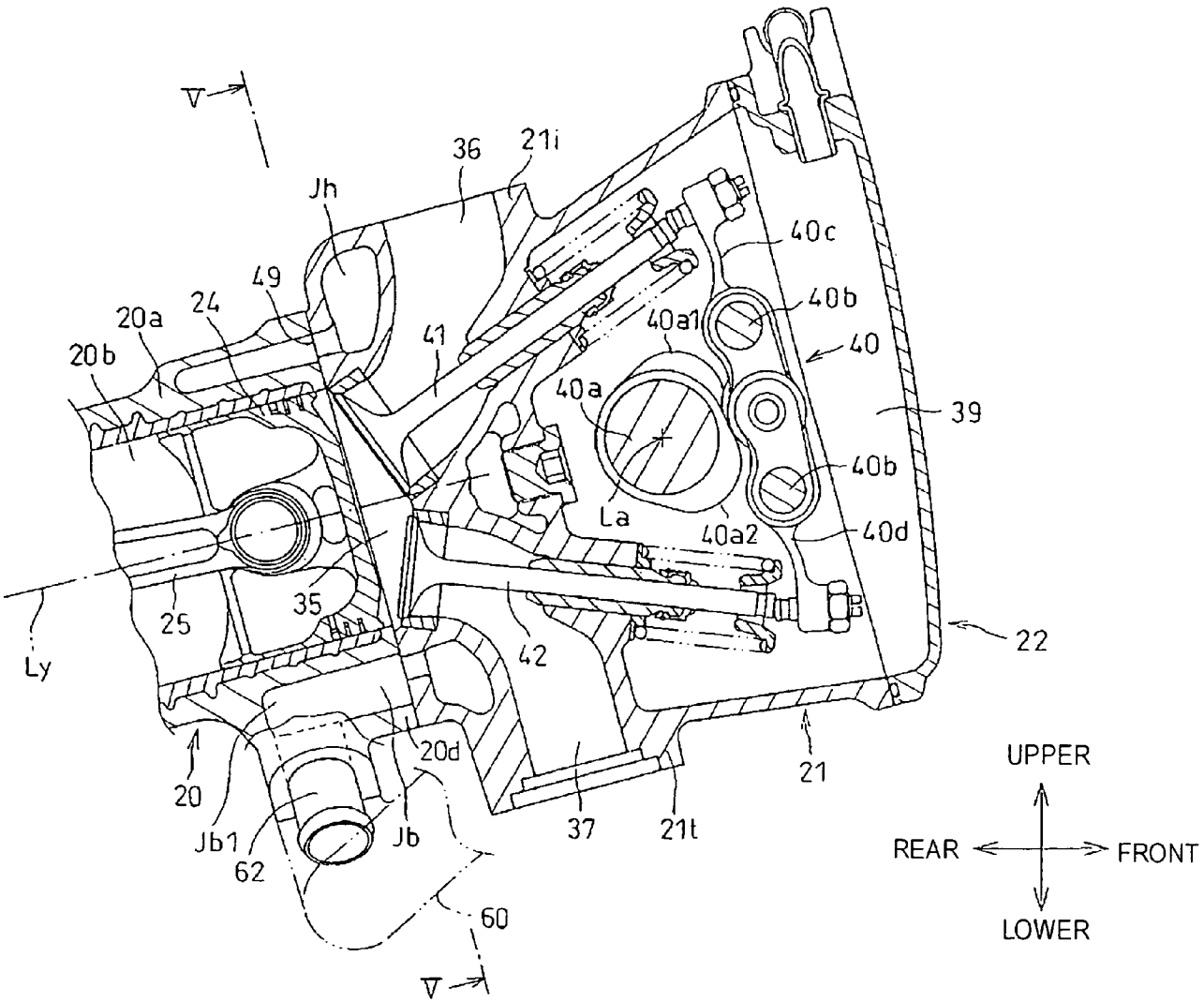
FIG. 4 is a cross-sectional view of an essential part, taken along line IV-IV in FIG. 2.
Figure 5:
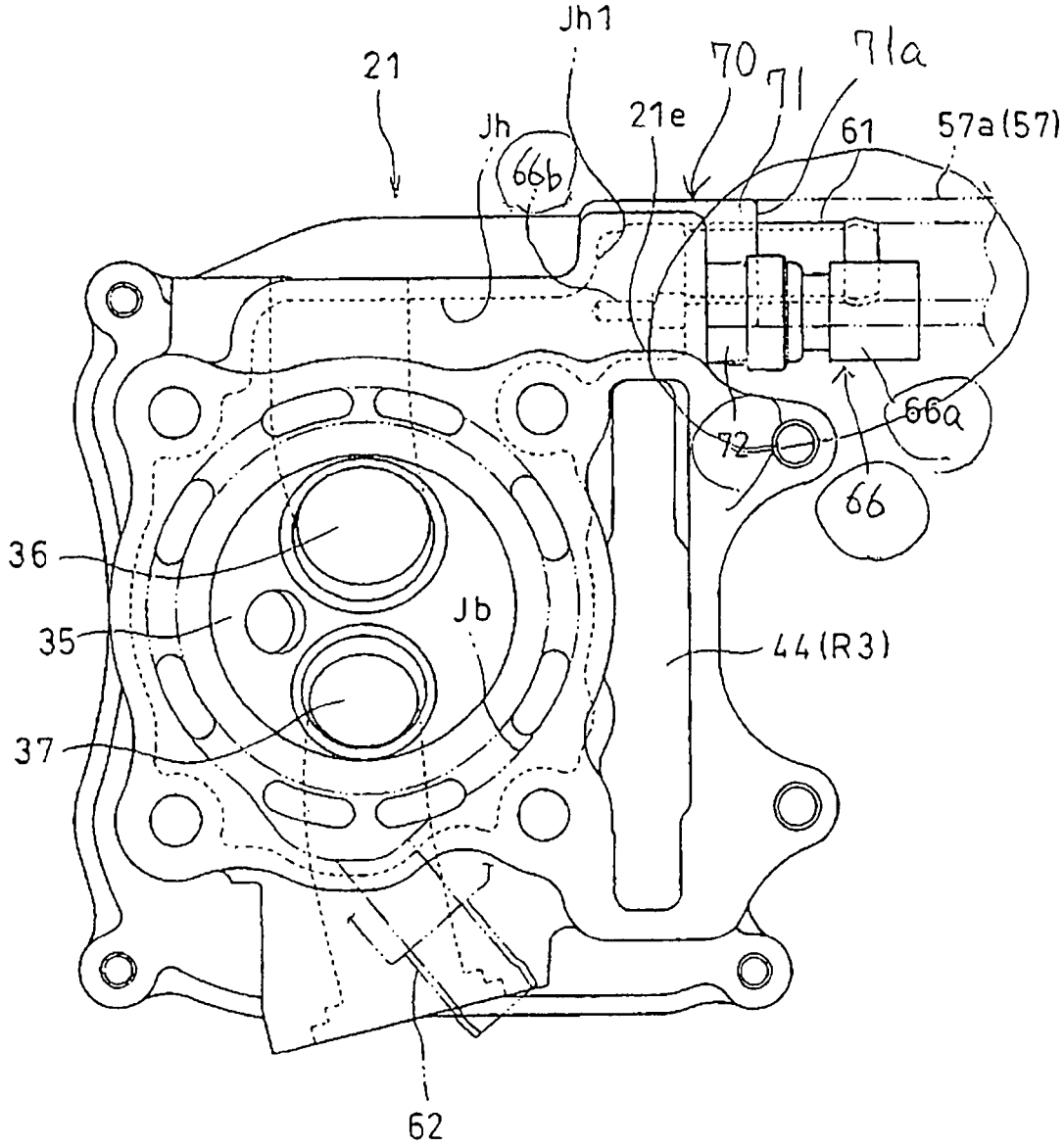
FIG. 5 is a cross-sectional view of an essential part, taken along line V-V in FIG. 4.

Referring to FIGS. 2, 4, and 5, the cylinder head 21 includes a combustion chamber 35 concavely formed in a location opposing the cylinder bore 20*b* in the cylinder axis direction, an intake port 36 and an exhaust port 37 both of which are open to the combustion chamber 35, and a spark plug 38 exposed in the combustion chamber 35. A valve train chamber 39 formed by the cylinder head 21 and the head cover 22 accommodates the valve train 40 that drives an intake valve 41 to open and close the intake port 36 and an exhaust valve 42 to open and close the exhaust port 37. The valve train 40 that is of an overhead cam shaft type includes a cam shaft 40*a* provided with valve operating cams, i.e. an intake cam 40*a*1 and an exhaust cam 40*a*2, and rotationally provided in the cylinder head 21, an intake rocker arm 40*c*, and an exhaust rocker arm 40*d*. The intake rocker arm 40*c* and the exhaust rocker arm 40*d* are rockably supported by rocker shafts 40*b* and rockingly driven by the intake cam 40*a*1 and the exhaust cam 40*a*2, respectively. The cam shaft 40*a* having a rotational axis La extending in parallel with the rotational axis Le is connected, via the transmission mechanism 43 that is of a wrapping connector type, to the crankshaft 26 and driven, by the crankshaft 26, at a rotational speed half that of the crankshaft 26. The transmission mechanism 43 includes a drive sprocket 43*a* formed integrally with the drive gear 33 and provided, as a driving part, on the crankshaft 26, a cam sprocket 43*b* provided, as a driven part, on the cam shaft 40*a*. An endless chain 43*c* which, as an endless transmission part, connects the sprockets 43*a* and 43*b*. The intake cam 40*a*1 and exhaust cam 40*a*2 mounted on the rotary cam shaft 40*a* open and close the intake valve 41 and exhaust valve 42 via the intake rocker arm 40*c* and exhaust rocker arm 40*d*, respectively, at a prescribed timing in synchronization with the rotation of the crankshaft 26.

The transmission mechanism 43 disposed to extend, along the cylinder axis Ly, from the crankcase 23 through the cylinder block 20 to the cylinder head 21 is accommodated in a chain chamber 44 which is formed, along the cylinder axis Ly, as an accommodation space extending from the right end portion 23*e* of the crankcase 23 through a right end portion 20*e* of the cylinder block 20 to a right end portion 21*e* of the cylinder head 21, the right end portions 23*e*, 20*e*, and 21*e* making up a right end portion, in the rotational axis direction (i.e. the lateral direction in the present embodiment) of the cam shaft 40*a* rotationally driven by the transmission mechanism 43, of the engine main body.

The chain chamber 44 includes a space R2 which is a cavity formed through, along the cylinder axis direction, the right end portion 20*e* that is a rightward end portion of the cylinder block 20, a space R3 which is a cavity formed through, along the cylinder axis direction, the right end portion 21*e* that is a right ward end portion of the cylinder head 21 to be communicated with the valve train chamber 39, and a space R1 formed in the right end portion 23*e* that is a rightward end portion of the crankcase 23, the spaces R1 and R3 being communicated with each other through the space R2 formed between the spaces R1 and R3 along the cylinder axis direction. Thus, in the present embodiment, the walls bounding the chain chamber 44 are formed by the right end portions 20*e*, 21*e*, and 23*e* of the cylinder block 20, cylinder head 21, and crankcase 23, respectively, and the dividing wall 32.

The chain 43*c* is wound around the drive sprocket 43*a* disposed in the space R1 and the cam sprocket 43*b* disposed to extend from the space R3 to the valve train chamber 39. Thus, the chain 43*c* is disposed to extend, along the cylinder axis Ly, through the three spaces R1, R2, and R3 in the chain chamber 44.

Figure 6:
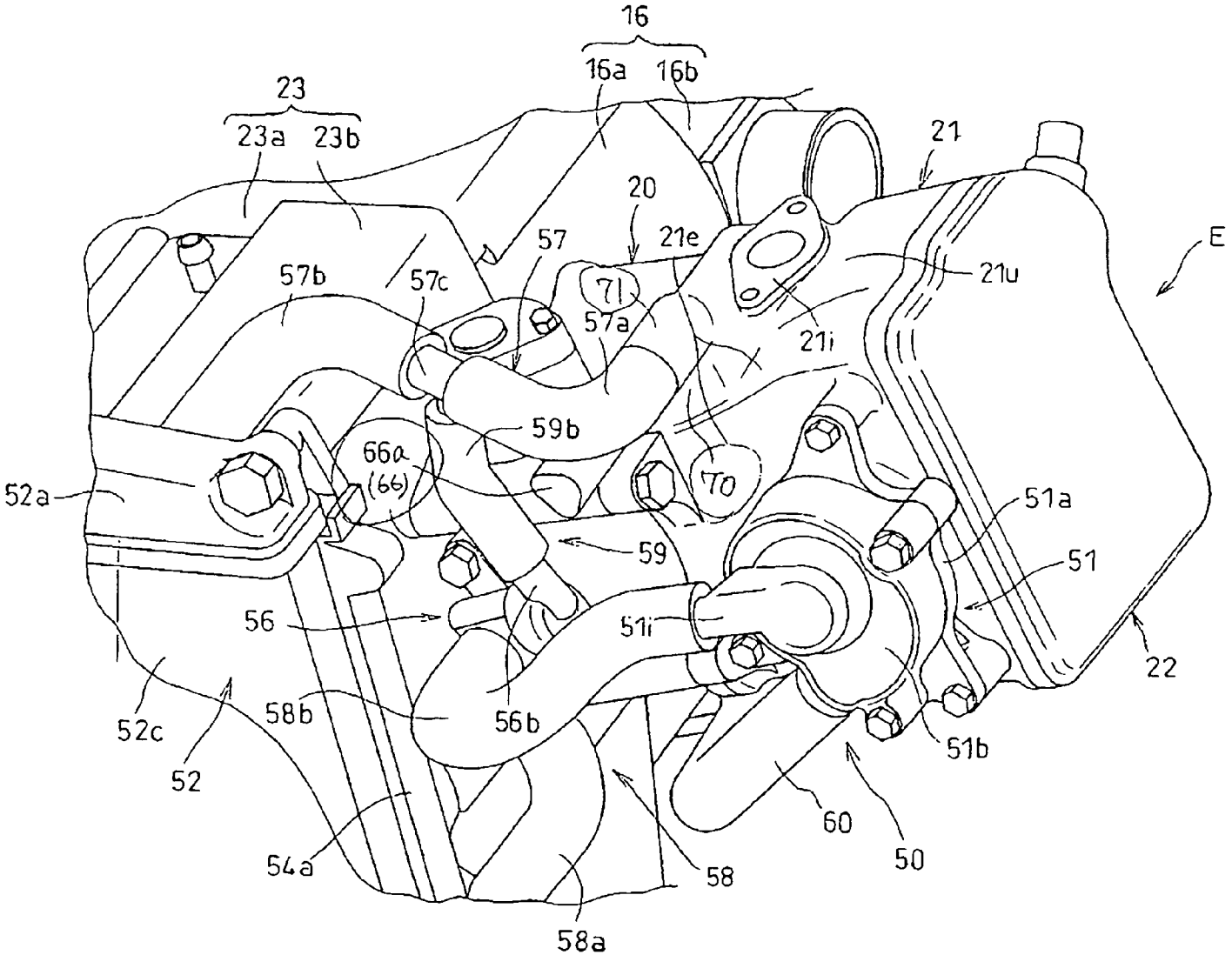
FIG. 6 is a perspective view of the internal combustion engine shown in FIG. 1.

Referring to FIG. 1, the internal combustion engine E includes an intake device 45 which is provided with an air cleaner 45*a*, a throttle valve device 45*b*, and an intake pipe 45*c* connected to a connection portion 211 of the cylinder head 21 and which leads intake air to the combustion chamber 35, a fuel injection valve 47 which is attached to the intake pipe 45*c* and which provides the intake air with fuel, and an exhaust device 46 which is provided with an exhaust pipe 46*a* for leading the exhaust gas discharged from the exhaust port 37 to outside the internal combustion engine E and a muffler 46*b*. Referring also to FIGS. 2, 4, and 6, the internal combustion engine E further includes a cooling device 50 which circulates cooling water for cooling the cylinder block 20 and the cylinder head 21.

The intake air flowing through an intake path formed by the intake device 45 is, after undergoing flow control by the throttle valve 45*b*1 provided in the throttle valve device 45*b*, mixed with the fuel supplied from the fuel injection valve 47 to become an air-fuel mixture. When the intake valve 41 opens, the air-fuel mixture flows into the combustion chamber 35 through the intake port 36 to be ignited by the spark plug 38 and burn. The pressure of the combustion gas generated by the burning of the air-fuel mixture drives the piston 24 causing the piston 24 to move reciprocally and thereby rotationally drive the crankshaft 26. Subsequently, when the exhaust valve 42 opens, the combustion gas flows out, as exhaust gas, to the exhaust port 37. The exhaust gas flowing out of the exhaust port 37 is discharged to the outside via the exhaust device 46 after flowing through the exhaust pipe 46*a* connected to a connection portion 21*t*, where the outlet of the exhaust port 37 is open, of the cylinder head 21. The power of the crankshaft 26 is automatically controlled by the transmission 15 according to the rotational speed of the engine and transmitted to the rear wheel 10 to rotationally drive the rear wheel 10.

Referring to FIGS. 2, 4, and 5, the cooling device 50 supplies and drains cooling water to and from a cylinder block water jacket Jb which is arranged, in the cylinder block 20, in a manner of surrounding the cylinder bore 20*b* and a cylinder head water jacket Jh which is arranged, in the cylinder head 21, in a manner for covering the combustion chamber 35 and communicated with the water jacket Jb via a communication hole provided in a gasket 49.

Figure 3:
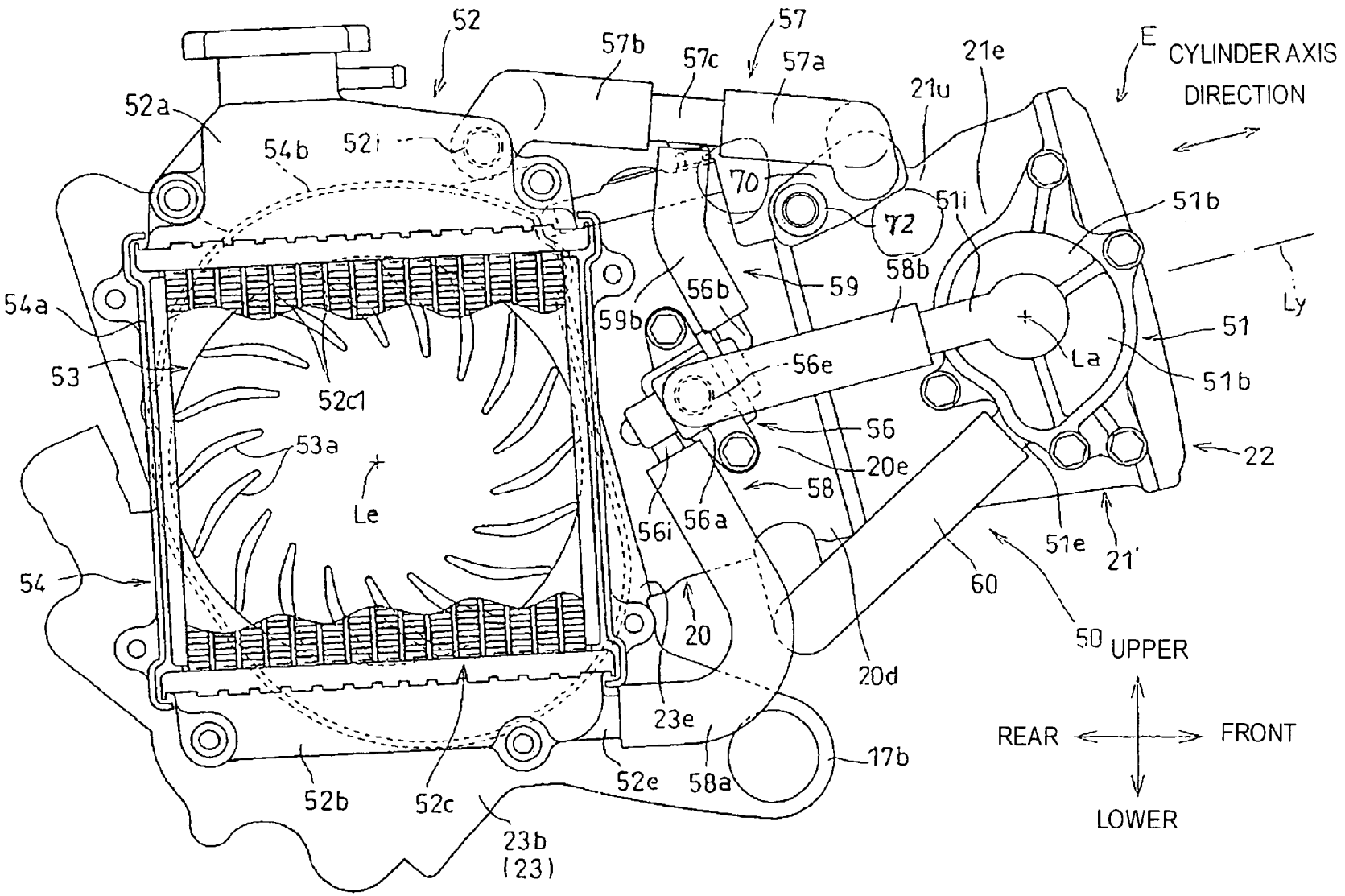
FIG. 3 is a right side view of an essential part of the internal combustion engine shown in FIG. 1.
Figure 7:
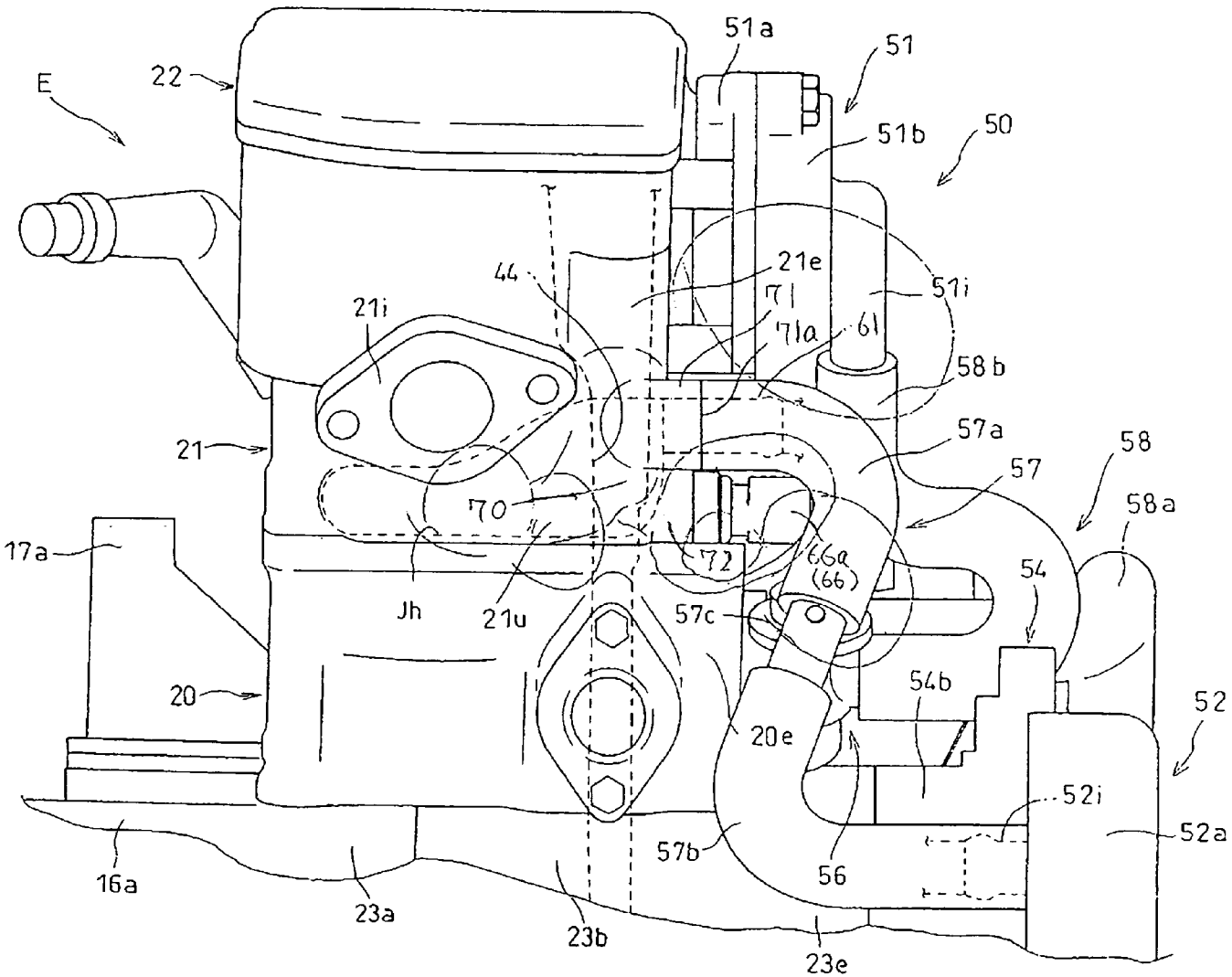
FIG. 7 is a top plan view of the internal combustion engine shown in FIG. 1.

Referring also to FIGS. 3, 6, and 7, the cooling device 50 includes a water pump 51 for pumping the cooling water to the water jackets Jb and Jh, a radiator 52 through which the cooling water of the water jackets Jb and Jh circulates, the cooling fan 53 for generating cooling wind to promote heat radiation from the cooling water circulating through the radiator 52, the shroud 54 covering the cooling fan 53, a radiator cover 55 for guiding the cooling wind toward a radiator core 52*c* of the radiator 52, a thermostat 56 for establishing or shutting off cooling water communication between the radiator 52 and the water pump 51 so as to allow or prohibit cooling water circulation through the radiator 52 according to the state of warming up of the internal combustion engine E, and a group of a plurality of cooling water pipes through which the cooling water circulates.

The water pump 51 is attached to the right end portion 21*e* (serving also as a wall of the chain chamber 44), i.e. a right end portion toward the radiator 52, of the cylinder head 21 such that it is positioned closer to the radiator 52 than the chain chamber 44. The water pump 51 includes a body 51*a* coupled to the right end portion 21*e*, the body 51*a* having a cylindrical portion extending through the right end portion 21*e* into the chain chamber 44, a cover 51*b* which is coupled to the body 51*a* by bolts and provided with an intake port portion 51*i* and a discharge port portion 51*e*, a pump shaft 51*c* rotatably supported by the body 51*a* and coupled to an axial end portion of the cam shaft 40*a*, and an impeller 51*d* coupled to the pump shaft 51*c* and disposed in a pump chamber 51*p* formed by the body 51*a* and the cover 51*b*.

The radiator 52 is disposed separated from the engine body in the right direction as defined in the foregoing. The radiator 52 is disposed almost entirely, in the front-rear direction, rearward of the cylinder block 20 and the cylinder head 21 (see FIG. 3) to be, as seen from the right side (in the direction in which the cooling wind flows in), overlapped with the crankcase 23. The AC generator 31 and the cooling fan 53 are disposed, on the right of the crankcase 23, between the chain chamber 44 and the radiator 52 (see FIG. 2).

The radiator 52 is attached, via the shroud 54, to the right end portion 23*e* (serving also as a wall of the chain chamber 44), i.e. a rightward end portion toward the radiator 52, of the crankcase 23. The radiator 52 includes an upper tank 52*a*, the upper tank 52*a* serving as an inlet tank provided with a connection portion 52*i* to which an inlet pipe 57 is connected, the inlet pipe 57 being for leading the high-temperature cooling water having circulated through the water jackets Jb and Jh and having thereby cooling the cylinder block 20 and the cylinder head 21 from the cylinder head 21 to the radiator 52. The radiator core 52*c* includes a large number of heat transfer tubes 52*c*1 into which the cooling water in the upper tank 52*a* flows. A lower tank 52*b* serves as an outlet tank where the low-temperature cooling water having radiated heat in the radiator core 52*c* and flowing out of the heat transfer tubes 52*c*1 collects. The lower tank 52*b* is provided with an outlet connection portion 52*e* to which an outlet pipe 58 is connected for leading, via the thermostat 56, the cooling water having radiated heat to the intake port portion 51*i* of the water pump 51.

The inlet connection portion 52*i* and the outlet connection portion 52*e* are provided, in the upper tank 52*a* and the lower tank 52*b*, respectively, in portions toward, in the front-rear direction (in the cylinder axis direction), a cooling water outlet portion 61 and a cooling water inlet portion 62, respectively (see FIG. 3).

Referring to FIG. 2, the cooling fan 53 coupled to the drive shaft 29 via a rotor 31*b* of the AC generator 31 is disposed, in the rotational axis direction, between the rotor 31*b* and the radiator core 52*c*. The cooling fan 53 includes a large number of vanes 53*a* of a radial flow type. The cooling fan 53 is disposed, in the cooling wind path formed by the radiator cover 55 and the shroud 54, downstream of the radiator core 52*c* to face, in the rotational axis direction, the radiator core 52*c*. It sucks in the air having passed the radiator core 52*c*, thereby causing air to flow into the radiator core 52*c* as a cooling wind from upstream (from the right side).

The shroud 54 is a single part made of a synthetic resin. It includes a holding portion 54*a* for holding the radiator 52 and a cylindrical cover portion 54*b* covering a radially outer circumference of the cooling fan 53. The cover portion 54*b* includes a wind outlet 54*e* having a plurality of circumferentially spaced-apart slits each formed approximately in parallel with the rotational axis Le (see FIG. 2). The cooling wind forced out of the accessory chamber 30 by the cooling fan 53 is radially outwardly discharged via the wind outlet 54*e*.

The radiator cover 55 coupled to the shroud 54 covers an outer circumference of the radiator 52 and is disposed to face the radiator core 52*c*. It includes a grille 55*a* having a latticed current plate. The grille 55*a* guides the air upstream of the radiator core 52*c*, as cooling air, toward the radiator core 52*c*.

Referring to FIGS. 3 to 7, the thermostat 56 is attached to the right end portion 20*e* (serving also as a wall of the chain chamber 44), i.e. a rightward end portion toward the radiator 52, of the cylinder block 20, so that it is disposed, in the rightward direction, closer to the radiator 52 than the chain chamber 44. In the front-rear direction, the thermostat 56 is disposed between the water pump 51 and the radiator 52 (see FIG. 3). The thermostat 56 includes a housing 56*a* coupled to the right end portion 20*e* and a thermostat valve (not shown) which operates being controlled by a temperature sensitive element housed in the housing 56*a*. The housing 56*a* is provided with a bypass port portion 56*b* into which the cooling water from the cylinder head water jacket Jh flows, an inlet port portion 56*i* which guides the cooling water from the radiator 52 into the housing 56*a*, and an outlet port portion 56*e* through which the cooling water from the radiator 52 flows out to the water pump 51.

When the internal combustion engine E is being warmed up, the thermostat valve allows the cooling water to flow from the bypass port portion 56*b* to the outlet port portion 56*e* whereas shutting off the cooling water path between the inlet port portion 56*i* and the outlet port portion 56*e*. After the internal combustion engine E has been warmed up, the thermostat valve allows the cooling water to flow from the inlet port portion 56*i* to the outlet port portion 56*e* whereas shutting off the cooling water path between the bypass port portion 56*b* and the outlet port portion 56*e*.

The cylinder head 21 is provided integrally with a pipe connection section 70. In the cylinder head 21, the pipe connection section 70 is disposed in a location, which is in the right end portion 21*e* of the cylinder head 21 while also falling in an upper end portion 21*u* of the cylinder head 21, toward the cylinder block 20 in the cylinder axis direction. The pipe connection section 70 includes a portion bulging upwardly (or bulging in one direction orthogonal (hereinafter referred to as an "orthogonal direction") to the cylinder axis Ly as seen from the right side).

The inlet pipe 57 is connected to the cooling water outlet portion 61 that is provided in the right end portion 21*e* while also falling in the upper end portion 21*u*. The inlet pipe 57 leads the cooling water having flowed out of the cylinder block water jacket Jb into the cylinder head water jacket Jh and having thereby cooled the cylinder head 21 to the radiator 52. The cooling water outlet portion 61 projecting rightward from the right end portion 21*e* or the pipe connection section 70 is disposed, in the rightward direction, closer to the radiator 52 than the chain chamber 44 (see FIGS. 5 and 7). The cooling water outlet portion 61 is open to an upwardly projecting upper end portion Jh1 of the cylinder head water jacket Jh (see FIG. 5). The upper end portion Jh1 is formed by the pipe connection section 70. The pipe connection section 70 and the upper end portion Jh1 are arranged such that at least a part of them, that is, in the present embodiment, an almost whole of the upper end portion Jh1 is overlapped with the chain chamber 44 as seen from above (hereinafter referred to as "as seen in a top plan view") or positioned identically with the chain chamber 44 in the lateral direction (see FIGS. 5 and 7).

The pipe connection section 70 integrally includes an outlet forming portion 71 and a fixing section 72. The cooling water outlet portion 61 includes a pipe joint attached to the outlet forming portion 71. The outlet forming portion 71 has a projecting portion which, in the right end portion 21*e*, projects to the right from the pipe connection section 70. The outlet forming portion 71 is positioned more to the right and is thus, closer to the radiator 52 than the chain chamber 44. The outlet forming portion 71 has an end face 71*a* positioned closer to the radiator 52 than the chain chamber 44. The inlet pipe 57 is connected to the cooling water output portion 61 from the right side at a location rightward of the end face 71*a*.

The fixing section 72 for a temperature sensor 66 for detecting the cooling water temperature is provided near the cooling water outlet portion 61. The temperature sensor 66 has a detection part 66*b* which is exposed near the upper end portion Jh1 of the cylinder head water jacket Jh. The temperature sensor 66 is fixed to the right end portion 21*e* of the cylinder head 21, that is, to be more concrete, to the pipe connection section 70 from the right side.

The cooling water outlet portion 61 is an outlet through which the cooling water flows out of the cylinder head water jacket Jh toward the radiator 52. Thus, the upper end portion Jh1 is where the cooling water having circulated through the water jackets Jb and Jh collects before flowing out of the engine main body toward the radiator 52. The upper end portion Jh1 is therefore a portion not much affected by local water temperature changes in the water jackets Jb and Jh. This allows the temperature sensor 66 to accurately detect the temperature of the engine body as a whole.

The fixing section 72, like the outlet forming portion 71, projects to the right in the right end portion 21*e*, and is positioned to the right of the chain chamber 44. The temperature sensor 66 has an exposed part 66*a* extending to the right outside the cylinder head 21.

The inlet pipe 57 includes a conduit 57*a* connected to the cooling water outlet portion 61, a conduit 57*b* connected to the inlet connection portion 52*i*, and a T-shaped pipe joint 57*c* which includes a branching portion connecting the conduits 57*a* and 57*b*. The inlet pipe 57 is provided with a conduit 59*b* branching from the pipe joint 57*c* to be connected to the bypass port portion 56*b*. A bypass pipe 59 communicated with the cylinder head water jacket Jh includes the conduits 59*b* and 57*a* and the pipe joint 57*c*. When the internal combustion engine E is being warmed up, the bypass pipe 59 leads the cooling water from the cylinder head water jacket Jh to the water pump 51 via the thermostat 56 without letting the cooling water flow into the radiator 52.

The outlet pipe 58 is connected to the intake port portion 51*i* extending, in the front-rear direction, toward the radiator 52. The outlet pipe 58 leads the low-temperature cooling water from the radiator 52 to the water pump 51 via the thermostat 56. The outlet pipe 58 includes a conduit 58*a* which is connected to the outlet connection portion 52*e* and the inlet port portion 56*i* and a conduit 58*b* which is connected to the outlet port portion 56*e* and the intake port portion 51*i*.

A supply pipe 60 is connected between the discharge port portion 51*e* and the cooling water inlet portion 62 provided in a lower end portion 20*d* of the cylinder block 20. The supply pipe 60 leads the cooling water that is, after flowing in from the radiator 52, discharged from the water pump 51 to the cylinder block water jacket Jb. The cooling water inlet portion 62 is open to a lower end portion Jb1 of the cylinder block water jacket Jb (see FIG. 4).

The inlet pipe 57, outlet pipe 58, bypass pipe 59, and supply pipe 60 are cooling water pipes. The inlet pipe 57, outlet pipe 58, and bypass pipe 59 are positioned more to the right, that is, closer to the radiator 52, than the right end portion 21*e* of the cylinder head 21.

The cooling water pumped out by the water pump 51 of the cooling device 50 flows from the cooling water inlet portion 62 into the cylinder block water jacket Jb via the supply pipe 60 and cools the cylinder 20*a*. The cooling water then flows into the cylinder head water jacket Jh and cools the cylinder head 21. Subsequently, the cooling water flows out of the cylinder head water jacket Jh to the cooling water outlet portion 61, further flows to the thermostat 56 via the bypass pipe 59, and then flows from the intake port portion 51*i* to the pump chamber 51*p* to be pressure-fed by the impeller 51*d* to circulate, without flowing through the radiator 52, through the circulation path for use during a warm-up operation, thereby promoting warming up of the internal combustion engine E.

After the internal combustion engine E has been warmed up in a state where the thermostat 56 effects control such that the cylinder head water jacket Jh and the water pump 51 are communicated with each other via the radiator 52 and such that communication between the cylinder head water jacket Jh and the water pump 51 via the bypass pipe 59 is shut off, the cooling water cooled by radiating heat in the radiator 52 is sucked in by the water pump 51 and the cooling water pressure-fed by the impeller 51*d* flows into the cylinder block water jacket Jb via the supply pipe 60 to cool the cylinder block 20. The cooling water then flows into the cylinder head water jacket Jh and cools the cylinder head 21. The cooling water flowing out of the cylinder head water jacket Jh further flows from the cooling water outlet portion 61 into the upper tank 52*a* of the radiator 52 via the inlet pipe 57. After being cooled by the cooling air at the radiator core 52*c*, the cooling water flows into the lower tank 52*b*. Subsequently, the cooling water flowing out of the lower tank 52*b* flows into the pump chamber 51*p* via the outlet pipe 58 and the thermostat 56 to be then pressure-fed by the impeller 51*d*. The cooling water thus circulates the circulation path for use after a warm-up operation, thereby cooling the cylinder block 20 and the cylinder head 21.

Next, the operation and effects of the embodiment configured as described above will be described.

The internal combustion engine E in which the radiator 52 is disposed to the right separated from the engine body includes the cooling water outlet portion 61 provided, in the right end portion 21*e* of the cylinder head 21, to be open to the cylinder head water jacket Jh, the cooling water outlet portion 61 being connected with the inlet pipe 57 for leading the cooling water flowing into the cylinder head water jacket Jh from the cylinder block water jacket Jb to the radiator 52. The cooling water outlet portion 61 is disposed to the right closer to the radiator 52 than the chain chamber 44, so that the cooling water, after cooling the cylinder block 20, flows into the cylinder head water jacket Jh and having thereby cooled the cylinder head 21 need not be made to go through the cylinder block 20 again before being sent out to the radiator 52. This simplifies the water circulation structure in the cylinder block 20 and makes the cylinder block 20 smaller. Furthermore, since the cooling water outlet portion 61 is disposed to the right closer to the radiator 52 than the chain chamber 44, the inlet pipe 57 can be shortened to reduce its line resistance and improve cooling efficiency. This allows the inlet pipe 57 to be laid out compactly. Still furthermore, with the cooling water outlet portion 61 projecting to the right in the right end portion 21*e* and being provided in the outlet forming portion 71 that is positioned closer to the radiator 52 than the chain chamber 44, the inlet pipe 57 can be further shortened by a length equivalent to the length of the outlet forming portion 71. This further reduces the line resistance of the inlet pipe 57.

The cooling water outlet portion 61 is open to the upper end portion Jh1 of the cylinder head water jacket Jh. The cooling water inlet portion 62 through which the cooling water having radiated heat at the radiator 52 flows into the cylinder block water jacket Jb is provided in the lower end portion 20*d* of the cylinder block 20. In this configuration, the cooling water flowing in from the lower end portion 20*d* enters the cylinder head water jacket Jh after flowing through the cylinder block water jacket Jb and subsequently flows out through the upper end portion Jh1 of the cylinder head water jacket Jh to the radiator 52. Thus, the cooling water circulates smoothly, so that the cylinder block 20 and the cylinder head 21 are cooled with improved efficiency. Moreover, with the upper end portion Jh1 being an upwardly projecting portion of the cylinder head water jacket Jh, the cooling water that enters the cylinder head water jacket Jh flows out to the cooling water outlet portion 61 via the upper end portion Jh1 after thoroughly cooling the cylinder head 21. This contributes toward improving the cooling efficiency for the cylinder head 21.

The cooling device 50 is provided with the water pump 51 and the thermostat 56 that are attached to the right end portions 21*e* and 20*e*, respectively, to be rightwardly closer to the radiator 52 than the chain chamber 44. In this configuration, even though the chain chamber 44 is disposed between, in the lateral direction, the water jackets Jb and Jh and the radiator 52 in the engine body, the cooling water outlet portion 61, the water pump 51, and the thermostat 56 are concentratedly disposed close to the radiator 52. Therefore, the inlet pipe 57 and the outlet pipe 58 can be shortened to improve cooling efficiency and their layout can be made compact. Furthermore, the radiator 52, the thermostat 56, and the water pump 51 are attached to different parts, i.e. the crankcase 23, the cylinder block 20, and the cylinder head 21. This contributes toward shortening the inlet pipe 57 and the outlet pipe 58 to improve cooling efficiency and making their layout compact.

The pipe connection section 70 including the cooling water outlet portion 61 is provided in the right end portion 21*e* of the cylinder head 21. The temperature sensor 66 is attached to the fixing section 72 of the pipe connection section 70 that includes the cooling water outlet portion 61 through which the cooling water from the cylinder head water jacket Jh flows toward the radiator 52. Thus, in the cylinder head water jacket Jh, the temperature sensor 66 is disposed at a location where the cooling water having circulated through the water jackets Jb and Jh collects before flowing out of the engine main body toward the radiator 52. This allows the temperature sensor 66 to detect the cooling water temperature at the location not much affected by local water temperature changes in the water jackets Jb and Jh, so that the temperature of the engine body as a whole can be detected with improved accuracy.

Figure 8:
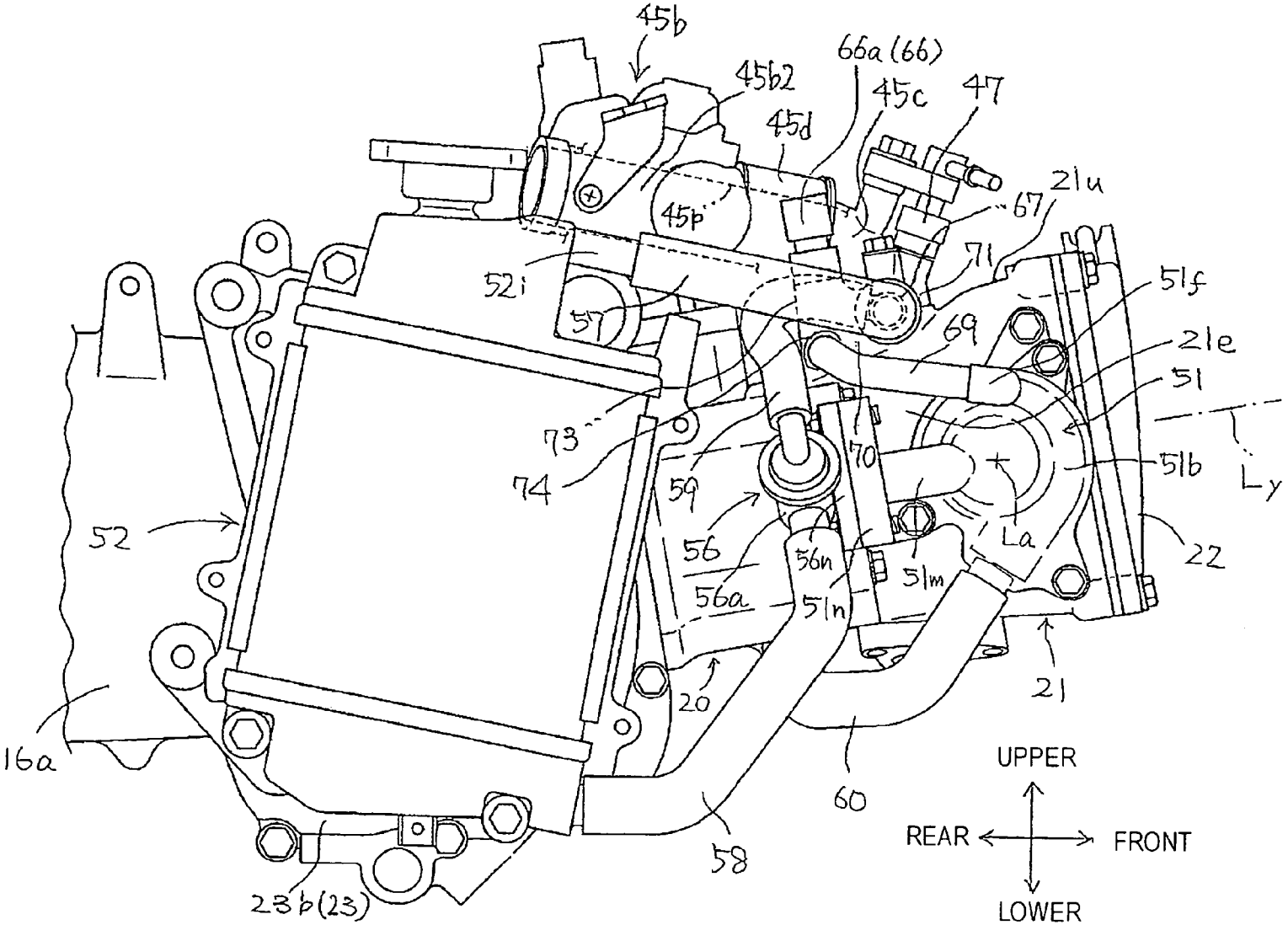
FIG. 8 is a view, corresponding to FIG. 3, of a water-cooled internal combustion engine according to a second embodiment of the present invention

A second embodiment of the present invention will be described below with reference to FIGS. 8 and 9. In the second embodiment, the cooling water piping for the cooling device 50 and the temperature sensor 66 are provided in different positions than in the first embodiment. In other respects, the first and second embodiments are basically identically configured. In the following, the second embodiment will be described centering on aspects differing from the first embodiment, and parts which are identical between the two embodiments will not be described or will be described only briefly. Also, components, including those not shown, of the second embodiment which are identical with or similar to those used in the first embodiment are assigned the same reference numerals as in the first embodiment.

The intake device 45 includes the throttle valve device 45*b* having a throttle body 45*b*2 connected to the air cleaner 45*a* (see FIG. 1), the intake pipe 45*c* that leads the intake air coming through the throttle valve device 45*b* to the intake port 36 (see FIG. 4), and a connection pipe 45*d* which is made of a flexible rubber pipe and which, being positioned between the throttle valve device 45*b* and the intake pipe 45*c*, connects the two. An intake path 45*p* which leads the intake air to the intake port 36 and further to the combustion chamber 35 (see FIG. 4) is formed by the throttle body 45*b*2 that is a body of the throttle valve device 45*b*, the connection pipe 45*d*, and the intake pipe 45*c*. The downstream end portion of the intake path 45*p* is open to the intake port 36. The intake pipe 45*c* is coupled, by bolts 18, to the connection portion 21*i* provided in the upper end portion 21*u* of the cylinder head 21.

Figure 9:
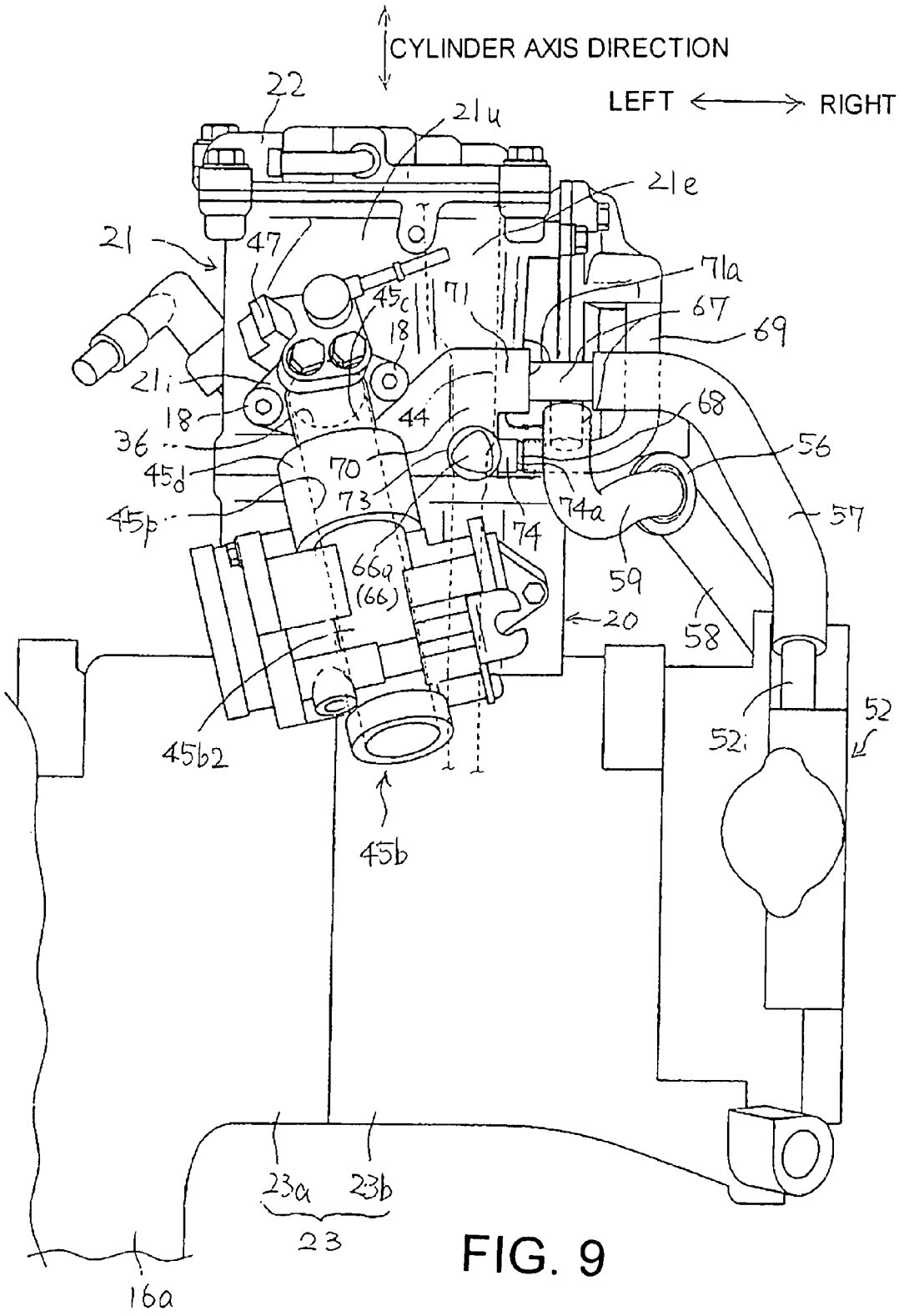
FIG. 9 is an approximately top plan view of the internal combustion engine shown in FIG. 8.

The intake path 45*p* extends, as shown in FIG. 9 showing a view seen in a direction approximately parallel to the one orthogonal direction, in the cylinder axis direction such that its longitudinal direction coincides with the cylinder axis direction as seen in a top plan view (or as seen in the one orthogonal direction).

An air vent pipe 69 for letting out the air accumulated in the pump chamber 51*p* of the water pump 51 that is attached to the right end portion 21*e* is positioned to the right closer to the radiator 52 than the right end portion 21*e* and the chain chamber 44. The air vent pipe 69 is connected, on its upstream side, to a connection portion 51*f* provided in the cover 51*b* of the water pump 51 and is in communication with the pump chamber 51*p* of the water pump 51 (see FIG. 2). On its downstream side, the air vent pipe 69 is connected to the pipe connection section 70 and is in communication with the upper end portion Jh1 of the cylinder head water jacket Jh (see FIG. 5).

The pipe connection section 70 formed integrally with the cylinder head 21 in the same position as in the first embodiment integrally includes the outlet forming portion 71, a fixing section 73, and an air inflow forming portion 74. The pipe connection section 70 forms, the same as in the first embodiment, the upper end portion Jh1 of the cylinder head water jacket Jh. The air inflow forming portion 74 is connected with the air vent pipe 69 that leads the air in the water pump 51 to the cylinder head water jacket Jh.

A cooling water outlet portion 67, which is equivalent to the cooling water outlet portion 61 used in the first embodiment, includes a T-shaped pipe joint having a branching portion connected to the outlet forming portion 71. An air inflow portion 68 includes a pipe joint attached to the air inflow forming portion 74. A pair of branching portions of the cooling water outlet portion 67 are connected with the inlet pipe 57 and the bypass pipe 59, respectively. With the bypass pipe 59 directly connected to the cooling water outlet portion 67, as compared with a case in which a bypass pipe is provided in an intermediate portion of the inlet pipe, the inlet pipe 57 can be further shortened and the layout of the inlet pipe 57 can be made more compact.

The outlet forming portion 71 and the air inflow forming portion 74 each include a projecting portion which projects to the right from the pipe connection section 70 in the right end portion 21*e*. They are located to the right of the chain chamber 44 to be closer to the radiator 52 than the chain chamber 44. The outlet forming portion 71 and the air inflow forming portion 74 have the end face 71*a* and an end face 74*a*, respectively, both of which are disposed closer to the radiator 52 than the chain chamber 44. The inlet pipe 57 is connected to the cooling water outlet portion 67 from the right side at a location to the right of the end face 71*a*. The air vent pipe 69 is connected to the air inflow portion 68 from the right side at a location rightward of the end face 74*a*.

The inlet pipe 57 extends from the cooling water outlet portion 67 to the connection portion 521 of the radiator 52 without being bent in a direction opposite to the rightward direction (that is, without being bent in the leftward direction) (see FIG. 9). This also allows the inlet pipe 57 to be shortened and its line resistance to be reduced. The air vent pipe 69 is disposed directly below the inlet pipe 57 and the bypass pipe 59 such that it is overlapped with the inlet pipe 57 and the bypass pipe 59 as seen in a top plan view.

In the pipe connection section 70, the fixing section 73 for the temperature sensor 66 is provided in the vicinity of the outlet forming portion 71, cooling water outlet portion 67, air inflow forming portion 74, and air inflow portion 68. The temperature sensor 66 has the detection part 66*b* (see FIG. 5) exposed near the upper end portion Jh1.

The fixing section 73 projects upwardly in the right end portion 21*e*. The exposed part 66*a* of the temperature sensor 66 fixed to the fixing section 73 from above extends upwardly to be orthogonal to the rightward direction as seen from the right side (namely, as seen in a right side view like that of FIG. 8) (i.e. in the one orthogonal direction).

The temperature sensor 66 and the intake path 45*p* are, as seen in a top plan view, disposed side by side in the lateral direction. To be more concrete, as seen in a top plan view, the temperature sensor 66 is disposed in a space surrounded by the intake path 45*p* and the inlet pipe 57 and bypass pipe 59 that are, in the pipe connection section 70, connected to the cooling water outlet portion 67 such that the temperature sensor 66 lies along with the intake path 45*p* in the rightward direction, i.e., in the direction toward the radiator 52 as seen from the intake path 45*p*. The pipe connection section 70, the upper end portion Jh1, the fixing section 73, and the exposed part 66*a* are arranged such that at least a part of them, that is, in the present embodiment, an almost whole of the fixing section 73, upper end portion Jh1, and exposed part 66*a* is overlapped with the chain chamber 44 as seen in a top plan view or positioned identically with the chain chamber 44 in the lateral direction (see FIG. 9). The temperature sensor 66 is disposed downwardly of the topmost portions of the throttle body 45*b*2 and connection pipe 45*d*, respectively, as seen in the vertical direction (or in the orthogonal direction) (see FIG. 8).

Along with the air to be let out, the cooling water also passes the air vent pipe 69, so that the air vent pipe 69 is, like the inlet pipe 57, a pipe for cooling water.

The thermostat 56 and the water pump 51 are connected together by coupling, using bolts, a flange 56*n* formed integrally with the housing 56*a* of the thermostat 56 and a flange 51*n* of a connection pipe 51*m* formed integrally with the cover 51*b* of the water pump 51.

The second embodiment configured similarly to the first embodiment can realize the following operations and effects in addition to effects similar to those realized by the first embodiment.

The temperature sensor 66 attached to the right end portion 21*e* of the cylinder head 21 extends upwardly, that is, in a direction orthogonal to the rightward direction outside the cylinder head 21 (i.e. in the one orthogonal direction). Thus, with the temperature sensor 66, even though being attached to the right end portion 21*e*, extending upwardly outside the cylinder head 21, the exposed part 66*a* exposed outside the cylinder head 21 of the temperature sensor 66 is prevented from interfering with the layout of such cooling water pipes as the inlet pipe 57 and the bypass pipe 59 disposed closer to the radiator 52 than the right end portion 21*e*. This promotes a compact laying out the cooling water piping.

The intake path 45*p* formed by the intake device 45 extends along the cylinder axis direction of the cylinder block 20 as seen in a top plan view. The pipe connection section 70 including the cooling water outlet portion 67 is provided in the right end portion 21*e*. The temperature sensor 66 is fixed to the fixing section 73 of the pipe connection section 70 in a location, as seen in the rightward direction, between the intake path 45*p* and the inlet pipe 57 and bypass pipe 59 that are connected, allowing the cooling water to pass through them, to the cooling water outlet portion 67 in the pipe connection section 70. Thus, the temperature sensor 66 is attached to the pipe connection section 70 including the outlet forming portion 71 where the cooling water outlet portion 67 is provided. The cooling water outlet portion 67 is an outlet for the cooling water flowing from the cylinder head water jacket Jh to the radiator 52. This, as in the case of the first embodiment, improves the accuracy in detecting the temperature of the engine body as a whole.

Furthermore, the temperature sensor 66 is disposed in a space between, as seen in the rightward direction, the intake path 45*p* and the inlet pipe 57 and bypass pipe 59 that are connected to the cooling water outlet portion 67 in the pipe connection section 70. Thus, the temperature sensor 66 can be compactly disposed.

The air vent pipe 69 for letting out the air accumulated in the water pump 51 that is attached to the right end portion 21*e* in a location to the right closer to the radiator 52 than the chain chamber 44 is connected to the right end portion 21*e* and is in communication with the cylinder head water jacket Jh. Thus, in the cylinder head 21, the air vent pipe 69 is connected to the right end portion 21*e* to which the water pump 51 is also attached. The air vent pipe 69 can, therefore, be shortened as compared with a case in which it is connected to the radiator 52. This contributes toward making the layout of the air vent pipe 69 and other pipes such as the inlet pipe 57 and bypass pipe 59 disposed closer, in the rightward direction, to the radiator 52 than the right end portion 21*e* compact.

In the air inflow forming portion 74 of the pipe connection section 70 having the fixing section 73 to which the temperature sensor 66 is attached, the air vent pipe 69 is connected to the air inflow portion 68 from the right side and communicated with the cylinder head water jacket Jh. In this arrangement, the air vent pipe 69 can be connected to the pipe connection section 70 without being interfered with by the temperature sensor 66, as the temperature sensor 66, even though being provided in the pipe connection section 70, extends upwardly. This also contributes toward making the layout of the air vent pipe 69 and inlet pipe 57 compact.

The fixing section 73 is disposed to overlap with the chain chamber 44 as seen in a top plan view. Namely, the fixing section 73 is disposed making use of a portion forming the chain chamber 44 of the cylinder head 21. Thus, the fixing section 73 is formed without causing the cylinder head 21 to be enlarged in the lateral direction.

In the following, partial modifications of the above embodiments will be described as to configurational modifications.

The cooling water outlet portions 61 and 67 may be formed integrally with the cylinder head 21.

The transmission mechanism 43 may be of a wrapping connector type having an endless transmission belt and pulleys around which the belt is wrapped. Also, the transmission mechanism 43 need not be of a wrapping connector type. It may include, for example, a gear train.

The walls of the chain chamber 44 may include the right end portions 20*e*, 21*e*, and 23*e* of the cylinder block 20, cylinder head 21, and crankcase 23, respectively, and another part (for example, a cover) which is discrete from the cylinder block 20, cylinder head 21, or crankcase 23 and which is coupled to the cylinder block 20, cylinder head 21, or crankcase 23. In this case, the another part (for example, a cover) is also a constituent element of the engine body.

The transmission mechanism may be one which drives a part other than the cam shaft of the valve train.

The internal combustion engine may be for use on other than a vehicle. The cooling fan may be rotationally driven by an electric motor. The internal combustion engine may be a multicylinder international combustion engine provided with a cylinder block having plural integrally-formed cylinders. The transmission need not be a belted transmission. It may be, for example, a geared transmission.

The throttle valve device may be an evaporator.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A water-cooled internal combustion engine, comprising:

an engine body including a cylinder block provided with a cylinder block water jacket and a cylinder head provided with a cylinder head water jacket; and a water pump for pressure-feeding cooling water to the water jackets, and a radiator through which the cooling water of the water jackets circulates;

wherein the radiator is disposed separated from the engine body in a prescribed direction; and a chain chamber extending, along a cylinder axis, from the cylinder block to the cylinder head in an end portion of the engine toward the radiator in the prescribed direction of the engine body, the water-cooled internal combustion engine comprising:

a cooling water outlet portion open to the cylinder head water jacket the cylinder head, the cooling water outlet portion being connected with an inlet pipe for leading the cooling water flowing out of the cylinder block water jacket into the cylinder head water jacket to the radiator; and the cooling water outlet portion is disposed between the radiator and the chain chamber.

2. The water-cooled internal combustion engine according to claim 1, wherein the cooling water outlet portion is open to an upper end portion of the cylinder head water jacket; and a cooling water inlet portion through which the cooling water having radiated heat at the radiator enters the cylinder block water jacket is provided in a lower end portion of the cylinder block.

3. The water-cooled internal combustion engine according to claim 2, wherein the cooling device is provided with a thermostat for performing control to establish or shut off a cooling water circulation through the radiator according to a state of warming up of the engine; and the water pump and the thermostat are both attached to the end portion to be closer, in the prescribed direction, to the radiator than the chain chamber.

4. The water-cooled internal combustion engine according to claim 3, wherein a temperature sensor which is attached to the portion, included in the end portion, of the cylinder head to detect cooling water temperature extends in a direction orthogonal to the prescribed direction outside the cylinder head.

5. The water-cooled internal combustion engine according to claim 4, wherein the water-cooled internal combustion engine further comprises an intake device forming an intake path extending in a cylinder axis direction of the cylinder block as seen in the orthogonal direction;

a pipe connection section including the cooling water outlet portion is provided in the portion, included in the end portion, of the cylinder head; and the temperature sensor is fixed to the pipe connection section in a location, as seen in the prescribed direction, between the intake path and a cooling water pipe which is connected to the pipe connection section and through which the cooling water passes.

6. The water-cooled internal combustion engine according to claim 2, wherein a temperature sensor which is attached to the portion, included in the end portion, of the cylinder head to detect cooling water temperature extends in a direction orthogonal to the prescribed direction outside the cylinder head.

7. The water-cooled internal combustion engine according to claim 1, wherein the cooling device is provided with a thermostat for performing control to establish or shut off a cooling water circulation through the radiator according to a state of warming up of the engine; and the water pump and the thermostat are both attached to the end portion to be closer, in the prescribed direction, to the radiator than the chain chamber.

8. The water-cooled internal combustion engine according to claim 7, wherein a temperature sensor which is attached to the portion, included in the end portion, of the cylinder head to detect cooling water temperature extends in a direction orthogonal to the prescribed direction outside the cylinder head.

9. The water-cooled internal combustion engine according to claim 1, wherein a temperature sensor which is attached to the portion, included in the end portion, of the cylinder head to detect cooling water temperature extends in a direction orthogonal to the prescribed direction outside the cylinder head.

10. The water-cooled internal combustion engine according to claim 9, wherein an air vent pipe for letting out air accumulated in the water pump that is attached to the portion, included in the end portion, of the cylinder head to be closer, in the prescribed direction, to the radiator than the chain chamber is connected, in the prescribed direction, to the pipe connection section and is in communication with the cylinder head water jacket.

11. The water-cooled internal combustion engine according to claim 1, wherein one end of the inlet pipe is connected to the cooling water outlet portion.

12. A water-cooled internal combustion engine, comprising:

a cylinder block being provided with a cylinder block water jacket;

a cylinder head being provided with a cylinder head water jacket; and a cooling device provided with a water pump for pressure-feeding cooling water to the water jackets;

a radiator operatively connected to said cooling device through which the cooling water of the water jackets circulates, said radiator being disposed to be separate from the cylinder block in a prescribed direction; and a chain chamber for accommodating a transmission mechanism for a valve system disposed extending, along a cylinder axis, from the cylinder block to the cylinder head and being provided in an end portion toward the radiator in the prescribed direction of the cylinder block, the water-cooled internal combustion engine comprising:

a cooling water outlet portion open to the cylinder head water jacket provided in a portion, included in the end portion, of the cylinder head, the cooling water outlet portion being connected with an inlet pipe for leading the cooling water flowing out of the cylinder block water jacket into the cylinder head water jacket to the radiator; and the upper end of the portion of the water jacket overlapping the chain chamber in the lateral direction and the outlet portion to be connected to an outlet pipe positioned closer to the radiator than the chain chamber.

13. The water-cooled internal combustion engine according to claim 12, wherein the cooling water outlet portion is open to an upper end portion of the cylinder head water jacket; and a cooling water inlet portion through which the cooling water having radiated heat at the radiator enters the cylinder block water jacket is provided in a lower end portion of the cylinder block.

14. The water-cooled internal combustion engine according to claim 13, wherein the cooling device is provided with a thermostat for performing control to establish or shut off a cooling water circulation through the radiator according to a state of warming up of the engine; and the water pump and the thermostat are both attached to the end portion to be closer, in the prescribed direction, to the radiator than the chain chamber.

15. The water-cooled internal combustion engine according to claim 14, wherein a temperature sensor which is attached to the portion, included in the end portion, of the cylinder head to detect cooling water temperature extends in a direction orthogonal to the prescribed direction outside the cylinder head.

16. The water-cooled internal combustion engine according to claim 15, wherein the water-cooled internal combustion engine further comprises an intake device forming an intake path extending in a cylinder axis direction of the cylinder block as seen in the orthogonal direction;

a pipe connection section including the cooling water outlet portion is provided in the portion, included in the end portion, of the cylinder head; and the temperature sensor is fixed to the pipe connection section in a location, as seen in the prescribed direction, between the intake path and a cooling water pipe which is connected to the pipe connection section and through which the cooling water passes.

17. The water-cooled internal combustion engine according to claim 13, wherein a temperature sensor which is attached to the portion, included in the end portion, of the cylinder head to detect cooling water temperature extends in a direction orthogonal to the prescribed direction outside the cylinder head.

18. The water-cooled internal combustion engine according to claim 12, wherein the cooling device is provided with a thermostat for performing control to establish or shut off a cooling water circulation through the radiator according to a state of warming up of the engine; and the water pump and the thermostat are both attached to the end portion to be closer, in the prescribed direction, to the radiator than the chain chamber.

19. The water-cooled internal combustion engine according to claim 18, wherein a temperature sensor which is attached to the portion, included in the end portion, of the cylinder head to detect cooling water temperature extends in a direction orthogonal to the prescribed direction outside the cylinder head.

20. The water-cooled internal combustion engine according to claim 12, wherein a temperature sensor which is attached to the portion, included in the end portion, of the cylinder head to detect cooling water temperature extends in a direction orthogonal to the prescribed direction outside the cylinder head.

21. The water-cooled internal combustion engine according to claim 20, wherein an air vent pipe for letting out air accumulated in the water pump that is attached to the portion, included in the end portion, of the cylinder head to be closer, in the prescribed direction, to the radiator than the chain chamber is connected, in the prescribed direction, to the pipe connection section and is in communication with the cylinder head water jacket.

22. The water-cooled internal combustion engine according to claim 12, wherein one end of the inlet pipe is connected to the cooling water outlet portion.

* * * * *